US009393713B2

(12) United States Patent
Honkanen

(10) Patent No.: US 9,393,713 B2
(45) Date of Patent: Jul. 19, 2016

(54) DISC CHIPPER WITH AN ADJUSTABLE KNIFE

(71) Applicant: VALMET TECHNOLOGIES, INC., Espoo (FI)

(72) Inventor: Tommi Honkanen, Pori (FI)

(73) Assignee: Valmet Technologies OY (FI)

( * ) Notice: Subject to any disclaimer, the term of this patent is extended or adjusted under 35 U.S.C. 154(b) by 0 days.

(21) Appl. No.: 14/536,858

(22) Filed: Nov. 10, 2014

(65) Prior Publication Data

US 2015/0129694 A1 May 14, 2015

(30) Foreign Application Priority Data

Nov. 13, 2013 (FI) ..... 20136114

(51) Int. Cl.
*B02C 18/18* (2006.01)
*B27L 11/00* (2006.01)

(52) U.S. Cl.
CPC ..... *B27L 11/005* (2013.01); *B02C 18/18* (2013.01)

(58) Field of Classification Search
CPC .... B02C 18/18; B02C 18/182; B02C 18/145; B02C 18/184; B02C 18/186; B02C 18/146; B02C 18/06; B02C 18/144; B02C 18/28; B27L 11/005
USPC ..... 241/294, 295, 189.1, 289, 290, 92
See application file for complete search history.

(56) References Cited

U.S. PATENT DOCUMENTS 4,194,545 A 3/1980 Kostermeier
5,857,508 A 1/1999 Jonkka
5,996,655 A * 12/1999 Cramond ..... B27G 13/10 144/162.1
2010/0090048 A1 4/2010 Jonkka

FOREIGN PATENT DOCUMENTS

FI 119318 B 10/2008

OTHER PUBLICATIONS

Office Action for Patent App. No. FI20136114 dated Dec. 5, 2014, and English translation.

* cited by examiner

*Primary Examiner* — Mark Rosenbaum
(74) *Attorney, Agent, or Firm* — Dickinson Wright PLLC

(57) ABSTRACT

A disc chipper having a knife disc having a plurality of segments, each segment separated from an adjacent by a chip opening extending segment approximately in the radial direction of the knife disc between the inner and outer peripheries of the knife disc. The disc chipper further has at least one knife for each segment, located in the segment in the vicinity of the chip opening preceding it in the rotational direction and extending a distance axially from said knife disc and supported between two opposing surfaces. The disc chipper further includes at least one wedge element for each segment, adapted to adjust the position of at least one of the opposing surfaces relative to the knife disc, for setting the axial reach of said knife to a desired value. Characteristically, the wedge element is situated in the segment essentially at the end adjacent to the preceding chip opening.

6 Claims, 6 Drawing Sheets

DISC CHIPPER WITH AN ADJUSTABLE KNIFE

This application claims benefit of Finland Patent Application No. FI 20136114, filed 13 Nov. 2013, the entire contents of which are incorporated herein by reference for all purposes.

BACKGROUND

1. Field

The present disclosure concerns a disc chipper, in particular a knife system therefor, by means of which the position of the cutting edges of individual knives can be adjusted relative to the knife disk.

2. Description of Related Art

Disc chippers are widely used for producing chips to be used for wood pulp production. The knife disc of the disc chipper is provided with knives arranged in an approximately radial direction, said knives chipping the wood against a fixed counterknife. For the part of the chipper, the chip quality is effected by the condition of the counterknife, the bearings of the knife disc, adequate rigidity of the chipper parts, correctly sharpened knives with correctly adjusted width and a small clearance between the knives and the counterknife. In current, relatively large disc chippers, also the planarity of the position of the knife cutting edge is a significant factor for a good chipping result. The planarity means that the knife cutting edges are in the same plane which is perpendicular to the shaft of the chipper. An absolute prerequisite for the successful adjustment of the knife clearance, in other words, the distance between the counterknife and the chipping knives, is a minimum deviation of the knife cutting edges from this plane. The knife clearance of the whole disc is always adjusted according to the knife which is closest to its counterknife.

The positions of the knife cutting edges are based on the manufacturing tolerance of the chipper parts and the correct adjustment of the width of the knives. Because the modern, readily adjustable and exchangeable knife systems of chippers include a multitude of parts, even small manufacturing inaccuracies can cause big differences as they accumulate. The differences even increase, when the parts come from different series of manufacture. Even if the width adjustment has been made carefully, whereby the mutual width difference between knives is in the range+/−0.1 mm, there are differences between the positions of the knife cutting edges when the knives are attached to the knife disc. Thus, the position differences between the knife cutting edges often range between 0.5-1.0 mm and lead, especially with certain wood species, to a prominent formation of filamentous material. Chip quality decreases as the distribution of particle sizes grows. That is, the amount of oversize particles and fines increases. Filaments are formed from the surface wood when the knife clearance is larger than normal. The knife is not able to cut off the tough surface wood, and the strings are carried between the counter knife and the knife to the periphery of the knife disc, and further from there into the chip material.

Precision adjustment of chip length and knife position is disclosed in e.g. Finnish patent 119318 (U.S. Pat. No. 7,735,762). In this method, the position of the knife pressed against the wear plate is adjusted by rotating the relevant wear plate around its hinge. Fine adjustment takes place at the next chip opening by means of an adjustment strip beneath the rear part of the relevant wear plate. The position of the adjustment strip is shifted in a wedge-shaped recess, whereby the rear end of the wear plate rises or falls. Correspondingly, the edge of the knife shifts in the opposite direction. In this method, the position of the knife edge is aligned with sufficient accuracy, that is, into the aforementioned plane which is perpendicular to the shaft. A drawback of this method, however, is that as the position of the wear plate shifts, the reach, i.e. the cut of the following knife changes. The cut refers to the measure from the front face of the rear part of the leading wear plate to the subsequent knife edge, taken in the direction of the disc shaft. The cut defines the resulting chip length. As a consequence of the fine adjustment, the length of the chip produced by the subsequent knife is different from the desired set length. From the point of view of chip quality, a chip length as uniform as possible is important.

Also in U.S. Pat. No. 6,056,030, a disc chipper and an adjustable wear plate are disclosed.

SUMMARY

The object of the disclosure is to provide a disc chipper, in which the edge of each knife is brought into the same plane which is perpendicular to the disc shaft with the other knife edges, without a significant change in the reach of the subsequent knife in the direction of the rotation of the disc. Characteristically for embodiments of the invention, this is achieved with a disc chipper in which the position of the knife is altered by means of at least one wedge element which is situated in a segment essentially at the end adjacent the preceding chip opening.

Due to embodiments of the invention, the variability in chip length between individual knives is avoided, nevertheless the influence of manufacturing imprecision can be avoided and the knife edges can be set into the same plane in the chipper disc with significantly higher precision than traditionally. Thus, a better quality in the produced chips is achieved, and the efficiency in further processing of the chips is increased.

According to an embodiment of the invention, the disc chipper can be designed with, for example, a structure allowing adjustment of the tilt angle of the wear plate. Hereby the knife edge is brought into the same plane perpendicular to the disc shaft with the other edges by shifting a wedge element which alters the angular position of the wear plate while the reach of the knife following the wear plate remains essentially unchanged.

In the alternative, a disc chipper according to an embodiment of the invention can be designed using a structure with a fixed wear plate. Thereby, by shifting the wedge element the knife base and further the pressure plate of the knife are set to the desired position, correspondingly positioning also the knife in the manner desired.

BRIEF DESCRIPTION OF DRAWINGS

The embodiments of the invention and its particulars are described in more detail in the following with reference to the appended drawings, in which.

DETAILED DESCRIPTION OF SPECIFIC EMBODIMENTS

Figure 1:
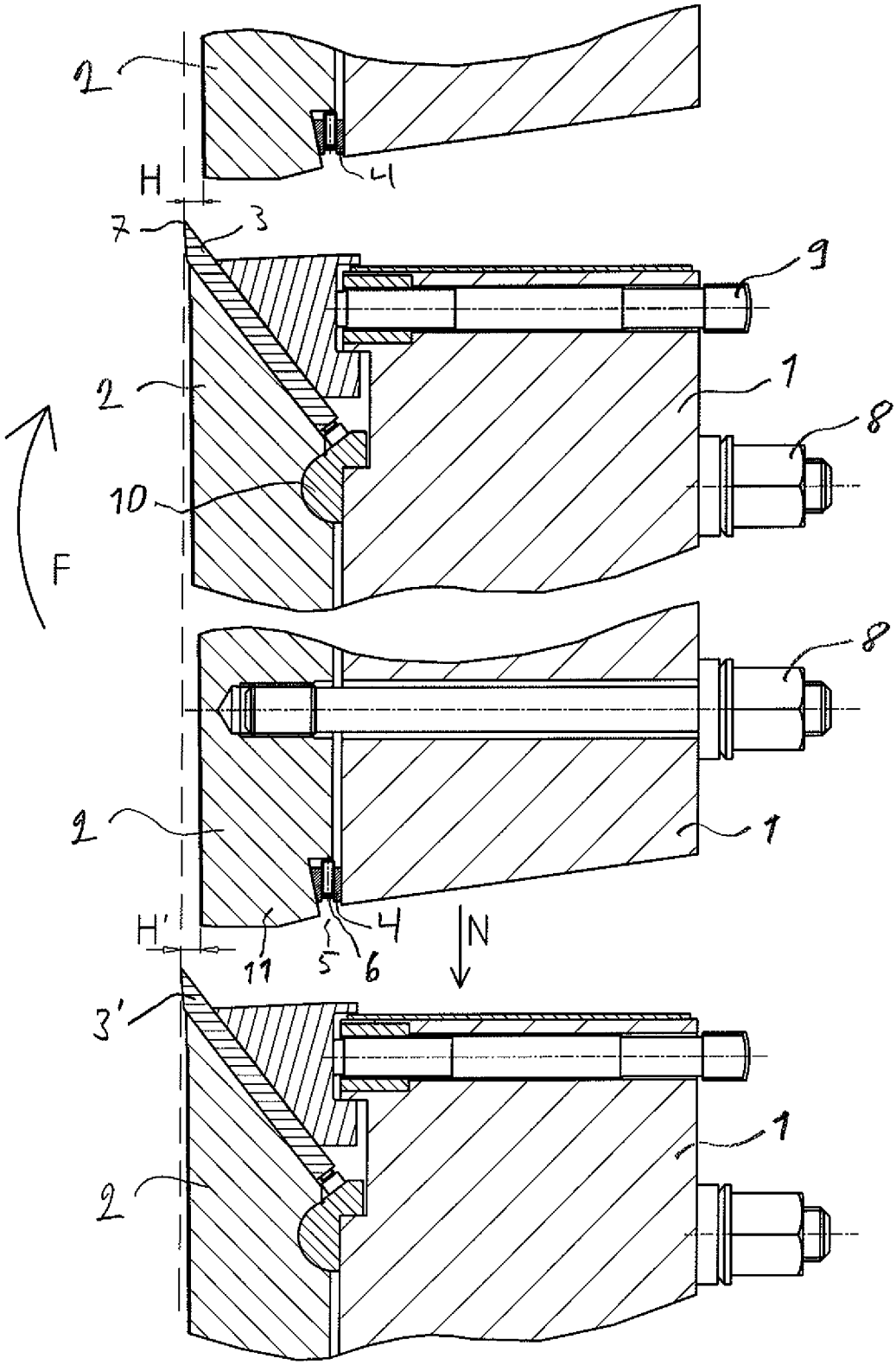
FIG. 1 shows a prior art design for precision adjustment of a knife in a disc chipper provided with an adjustable wear plate.

In FIG. 1, showing a section of a knife disc 1 in a prior art disc chipper, wear plates 2 are visible at three different locations on the disc 1. Precision adjustment of knife 3 is carried out by changing the position of the wedge-formed adjustment strip 4 in the wedge recess 5 between knife disc 1 and rear part 11 of the wear plate. Wedge-shaped adjustment strip 4 is positioned by means of the associated screw 6. When the edge 7 of knife 3 shall be shifted closer to knife disc 1, that is, the reach of the knife shall be reduced, firstly the fastening screws 8 of the wear plate and the fastening screws 9 of the knife are loosened, after which screw 6 is turned inwards. Thereby adjustment strip 4 is shifted in the direction of arrow N and the wear plate turns around hinge 10 in the direction of arrow F. Simultaneously the knife edge 7 shifts closer to the knife disc, in a direction perpendicular to the knife disc.

This action results in a change in the position of the rear part 11 of the wear plate such that the measure H' decreases. In other words, the reach of the following knife 3' is reduced. As a consequence, chip length is reduced for knife 3' also. Each precision adjustment changes the chip length correspondingly for the trailing knife. In practice, the required precision adjustment, i.e. the shift in the position of knife edge 7 in the direction perpendicular to the knife disc is 0-0.7 mm. When the chip length is changed, the adjustment strip 4 is replaced with one of different thickness. The change in chip length is typically carried out in about 1 mm increments in the position of the knife edge.

Figure 2:
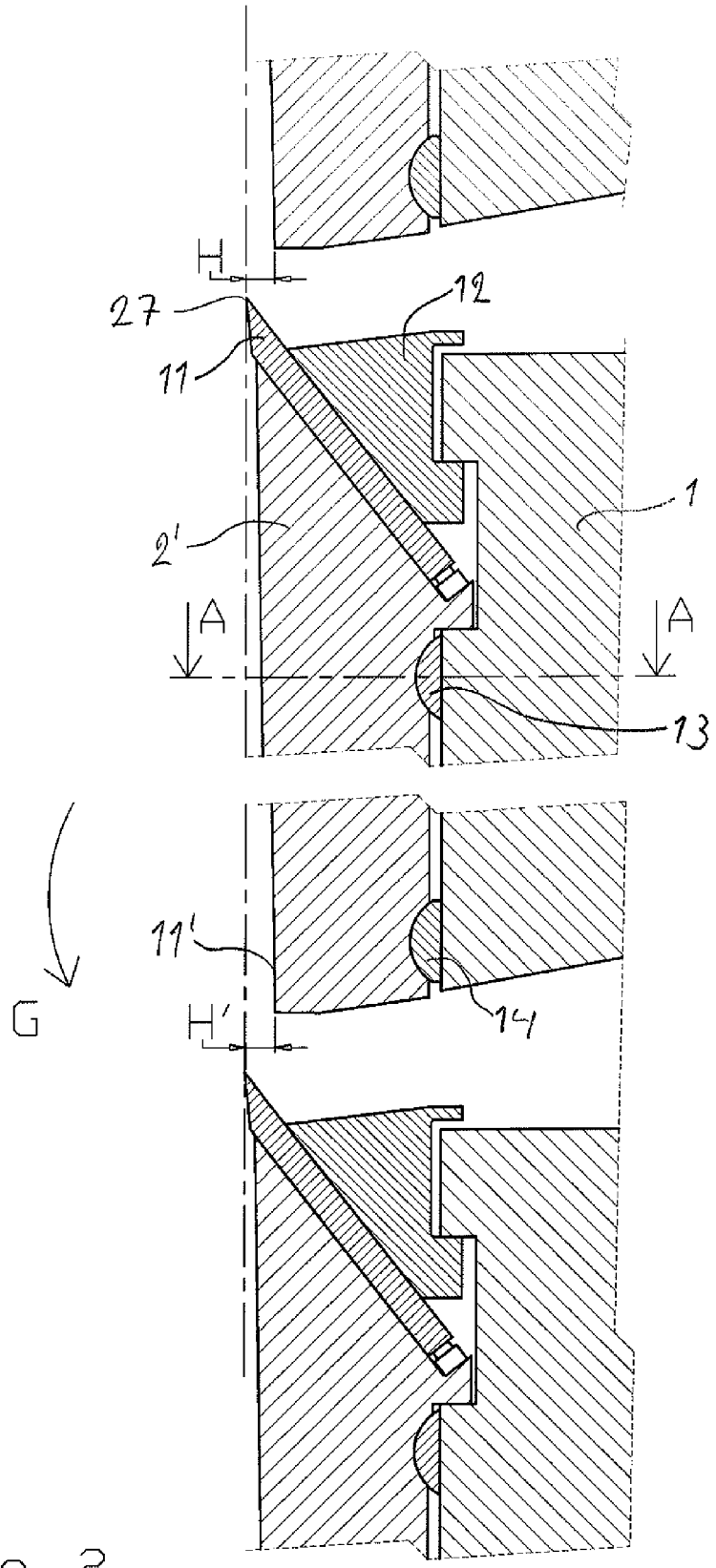
FIG. 2 shows a precision adjustment system according to an embodiment of the present invention.
Figure 3:
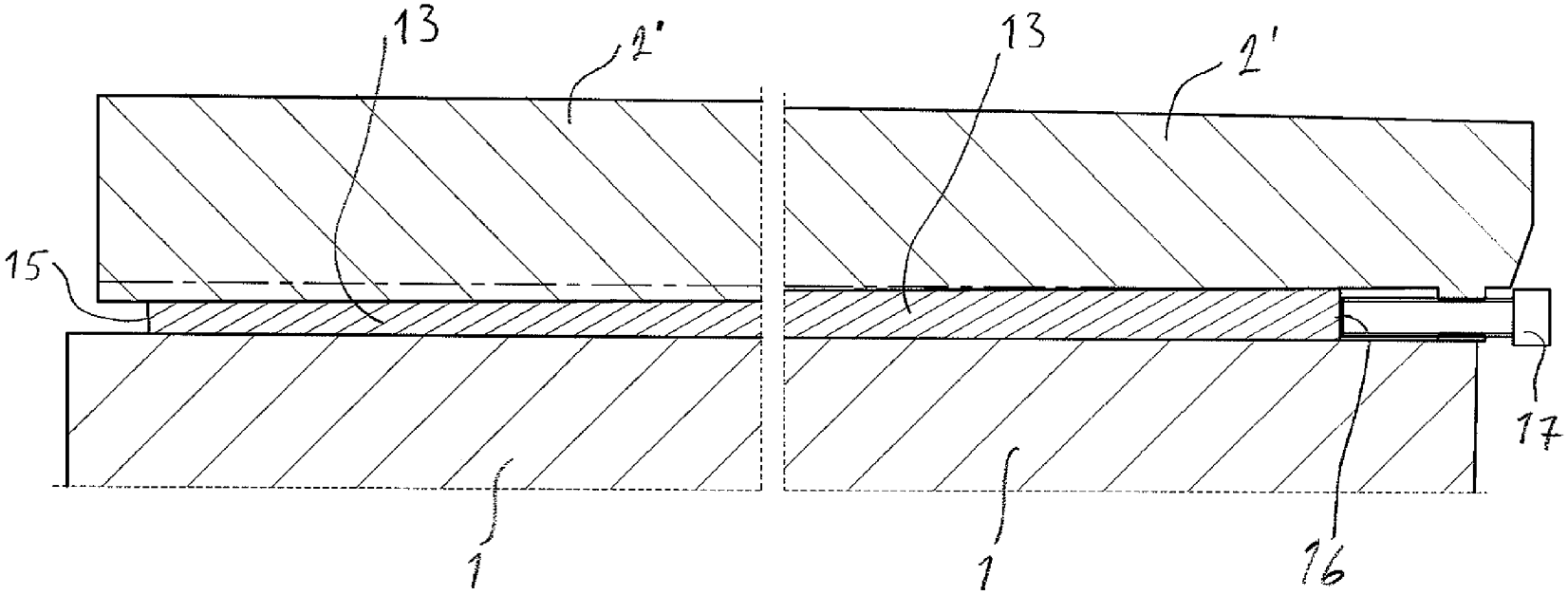
FIG. 3 shows section A-A in FIG. 2.

In FIGS. 2 and 3 illustrate an arrangement according to an embodiment of the present invention for carrying out precision adjustment of the knife in such a manner that the reach of the trailing knife does not change significantly. In FIG. 2 a knife disc 1, and attached to it, a wear plate 2' is shown. The fastening screws of the wear plate are not shown. Knife 11 is pressed against wear plate 2' with knife base 12. The fastening screws of knife base 12 are not shown. Between wear plate 2' and knife disc 1 is a hinge strip 13 and a chip length adjustment strip 14. When the position of knife edge 27 is shifted in the perpendicular direction relative to the knife disc, the position of the wedge shaped hinge 13 of wear plate 2' is adjusted in the longitudinal direction of the hinge on the surface of knife disc 1.

In FIG. 3, which represents the section A-A of FIG. 2, the wedge shaped hinge 13 between wear plate 2' and the knife disc 1 is shown. In FIG. 3, hinge end 15 which is closer to the knife disc periphery is narrower in the direction perpendicular to knife disc 1 than the end 16 which is closer to the knife disc center. When the reach H of edge 11 is to be increased, the fastening screws of knife base 12 and the fastening screws of wear plate 2' are loosened. Next, the wedge shaped hinge 13 is shifted towards the periphery of knife disc 1 by means of screw 17 situated at the edge of wear plate 2'. The wear plate 2' sets in its new position, turning in the direction of arrow G around the chip length adjustment strip 14. Edge 27 of the tightened knife also shifts farther from knife disc 1 and the reach H increases. Since wear plate 2' turns around chip length adjustment strip 14, the position of the surface 11' of the wear plate rear part does not change significantly along the greater part of the wear plate length, and consequently the reach H' of the trailing knife does not change.

Figure 4:
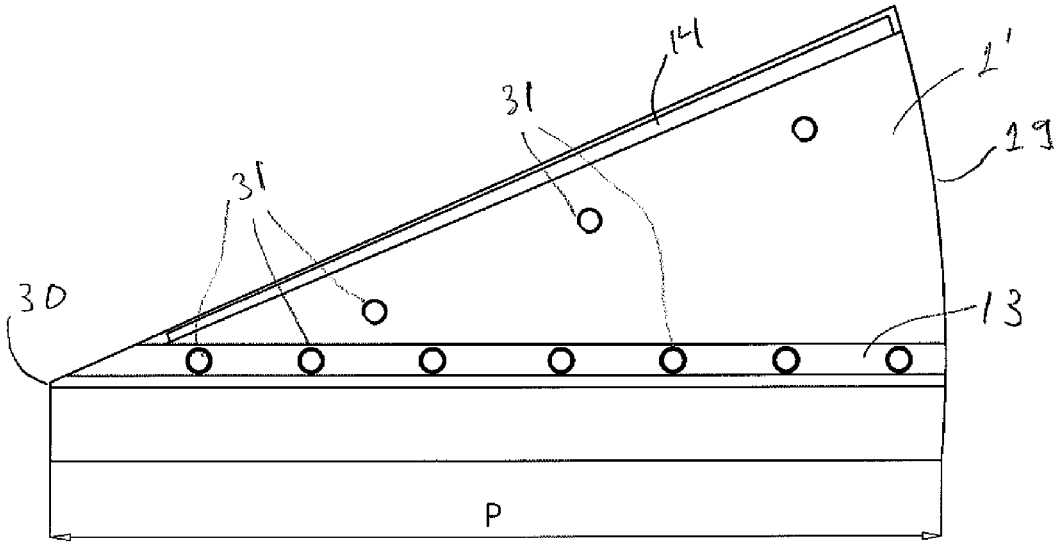
FIG. 4 shows a wear plate as viewed from the direction of the knife disc.

In FIG. 4, the rear surface of wear plate 2' is shown. Typically, the length P of wear plate 2, 2' is 800-1100 mm. Adjustment strip 14 and hinge strip 13 extend approximately from the outer periphery 29 of the wear plate to its inner periphery 30. In FIG. 4 are also shown the threaded holes 31 for the fastening screws for the wear plate. Knife disc 1 and its parts are dimensioned so, that adjustment strip 14 and hinge strip 13 are in even contact along their whole length to the wear plate 2' and on their other side to the knife disc 1. When the hinge strip 13 is raised for example 0.5 mm, the wear plate 2' sets in its new position when tightened down. Thereby, wear plate 2' is still in contact with hinge strip 13 along its whole length, but with hinge strip 14 only on the outer periphery 29 side. Thereby a triangular slit, increasing in width towards the outer periphery 30, remains between the wear plate and the adjustment strip contacting the knife disc.

Due to dimensional inaccuracies in machining, this is not always the case in practice. Moreover, experience has shown that when the knife edge remains too low, this situation is remedied by raising the hinge strip along its whole length using a spacer of appropriate thickness, and the wear plate is adequately fixed when torqued down. In practice, a wear plate of about 1 m length bends sufficiently to leave a possible slit only just at the edge facing the inner periphery. At the inner periphery, chipping occurs only marginally and its impact on the chip quality as a whole is negligible.

For adjustment of the hinge strip 13, an adjustment screw 17 can be used at both ends of the wedge. Adjustment screw 17 can also be attached to hinge strip 13 so that the strip follows the screw in both directions. Also other known methods can be used for adjusting the position of hinge strip 13, such as lever mechanisms or hydraulic. In FIGS. 2 and 3, the backing surface for hinge strip 13 in wear plate 2' is a wedge-shaped groove. Alternatively, a wedge-shaped backing surface can be in the knife disc 1.

Figure 5:
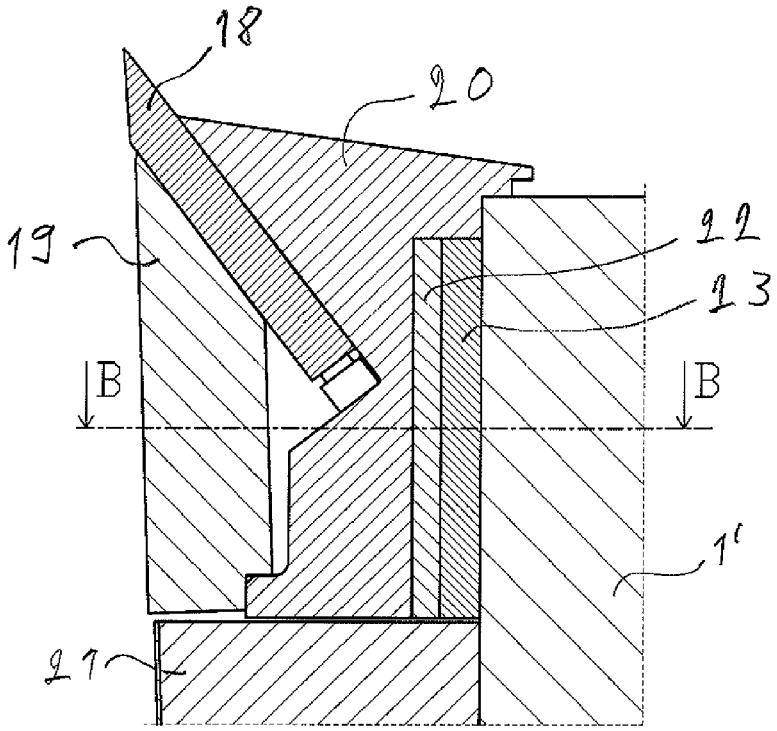
FIG. 5 shows an implementation of the invention in another type of knife fastening system.
Figure 6:
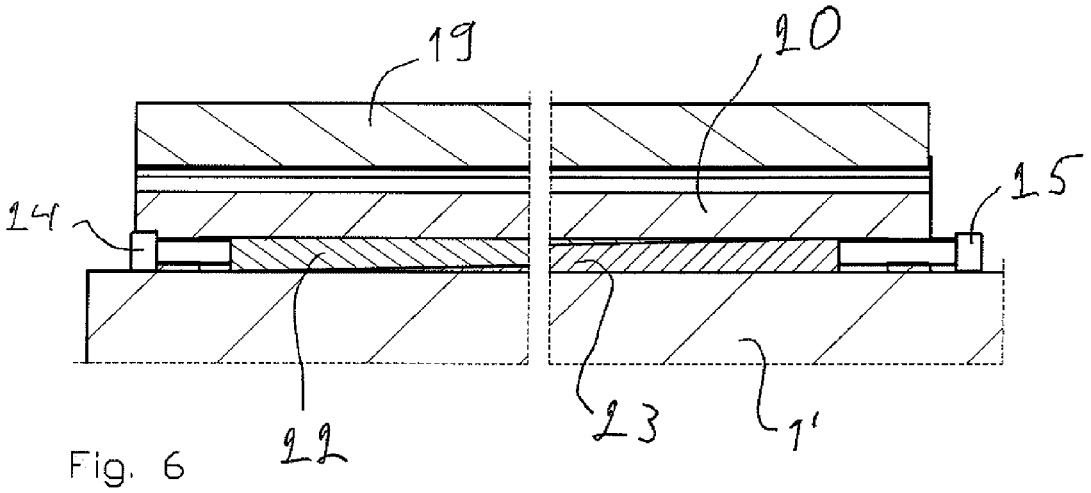
FIG. 6 shows section B-B in FIG. 5.

In FIGS. 5 and 6, a precision adjustment arrangement according to an embodiment of the invention is shown in another type of knife fastening system. In the method, knife 18 is fixed by compressing by means of a knife compression element 19 against knife base 20. The fastening screws for knife compression element 19 are not shown. In this method, the wear plate does not make contact with knife 18, so adjusting the position of the knife does not affect the position of wear plate 21. Precision adjustment according to the invention is implemented using flat wedges 22, 23 between knife base 20 and knife disc 1'. As shown in FIG. 6, the position of wedges 22, 23 is adjusted with screws 24, 25.

Figure 7:
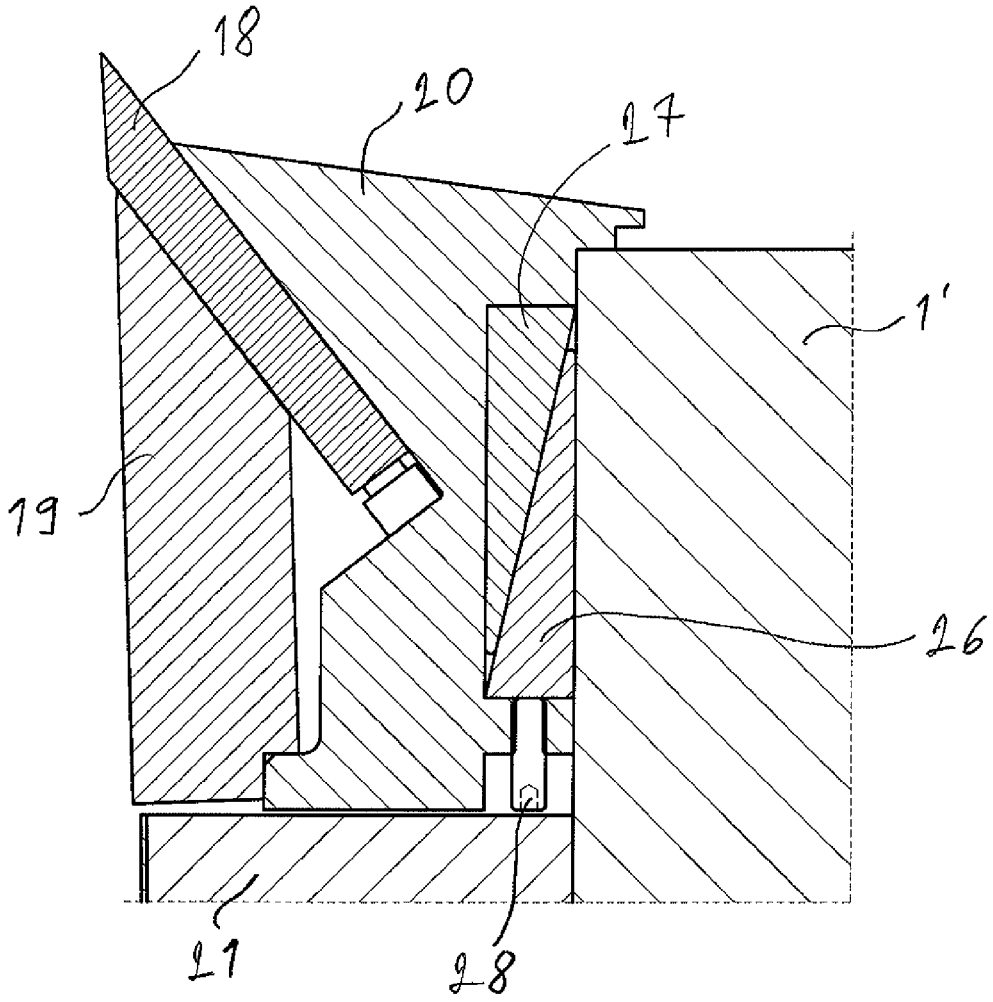
FIG. 7 shows a further embodiment of the invention.

In FIG. 7, another embodiment of the invention is shown. The wedges 26, 27 move in the direction of the tangent of knife disc 1'. In the design of FIG. 7, only one wedge 26 is shifted with screws 28. In FIG. 7, only a single adjustment screw 28 is shown. In the method, at least 2 screws are required to position the same wedge 26. Alternatively, wedge 27 can be adjusted.

A disc chipper according to an embodiment of the invention comprises a knife disc having several segments. Each segment is separated from an adjacent segment by a chip opening, preferably extending approximately in the radial direction of the knife disc 1 between its inner and outer peripheries. The chip opening preferably does not, however, extend outside the knife disc, but is limited inside it. The task of the chip opening is to function as a channel for transporting chipped material away from the knife side of knife disc 1.

The disc chipper further comprises at least one knife 11; 18, preferably one for each segment. Knife 11; 18 is most preferably located in the vicinity of the chip opening preceding the corresponding segment in the direction of rotation Knife 11; 18, preferably its edge 27, extends a distance from knife disc 1 in the axial direction of the disc. Preferably, knife 11, 18 extends in its longitudinal direction approximately in the radial direction of the knife disc between its inner and outer peripheries, as does the chip opening. Knife 11; 18 is supported between two opposing surfaces.

Further, the disc chipper comprises at least one wedge element 13; 22, 23, preferably one for each segment. Similarly as for the knife 11: 18, the wedge element may extend approximately in the radial direction of the knife disc between its inner and outer peripheries. Wedge element 13; 22, 23 is adapted to adjust the position of at least one of the two opposing surfaces in relation to the knife disc, in order to set the axial reach of said knife 11, 18 from knife disc 1 to a desired value. Preferably, the wedge element 13; 22, 23 is adapted between knife disc 1 and component 12, 20 which comprises at least one of the opposing surfaces, whereby by shifting wedge element 13; 22, 23, the surface supporting the knife 11; 18 can be adjusted and thus also the axial position of the knife 11; 18 itself relative to knife disc 1. In the knife disc 1 or in the component 12; 20 comprising at least one of the two opposing surfaces, a groove can be arranged which is adapted to function together with wedge element 13; 22. Wedge element 13; 22, 23 should be located in the segment essentially at the end adjacent the preceding chip opening. Thereby a shift in the position of wedge element 13; 22, 23 causes a minimum effect in the segment in the position of the components located at the end adjacent to the following chip opening.

In a disc chipper according to an embodiment of the invention, each segment additionally comprises a wear plate 2' located opposite to the knife disc 1, the wear plate preferably extending essentially between a leading and a trailing opening in the direction of rotation. Additionally, each segment is provided with a knife base 12, located between knife disc 1 and wear plate 2' adjacent to the preceding chip opening in the rotation direction. Knife base 12 is preferably adapted to press against the knife, i.e. towards the wear plate 2'. As knife base 12 is pressed against knife 11, knife 11 is thus compressed between wear plate 2' and knife base 12. Thus, knife base 12 and wear plate 2' form two opposing surfaces which support knife 11.

In this embodiment, a hinge strip 13 is located between wear plate 2' and knife disc 1, essentially at the end adjacent to the chip opening preceding the corresponding segment. Hinge strip 13 is wedge-shaped in its radial direction relative to the knife disc, and preferably it extends approximately in a radial direction of the knife disc between the inner and outer peripheries of the disc. Thus, by shifting hinge strip 13 towards the inner or the outer periphery, the axial position of the wear plate 2' relative to the knife disc can be raised or lowered. This further affects the position of knife 11 in a corresponding manner. Thus, the hinge strip 13 acts as a wedge element as mentioned. In other words, by means of hinge strip 13, the end of the wear plate 2' adjacent to a preceding chip opening in the rotational direction can be set axially relative to the knife disc 1 by shifting said hinge strip 13 in the radial direction of the knife disc 1. The hinge strip 13 is preferably convex on the side of the wear plate 2', whereby a correspondingly shaped groove can be arranged in the wear plate 2'. Alternatively, the hinge strip can preferably be convex on the side of the knife disc 1, whereby a corresponding groove can be arranged in the knife disc 1. If a groove for the hinge strip 13 is arranged in the wear plate 2' or the knife disc 1, said groove can be wedge-shaped as the hinge strip.

Further, in the present embodiment, each segment comprises an adjustment strip 14 located between wear plate 2' and knife disc 1, essentially at the end adjacent to the chip opening succeeding the corresponding segment. Most preferably, the adjustment strip extends approximately in the radial direction of the knife disc between its inner and outer peripheries. Also adjustment strip 14 is preferably convex either on the side of the wear plate or on the side of the knife disc, whereby a groove fitting the convexity of adjustment strip 14 can be arranged in either the wear plate 2' or the knife disc. By varying the thickness of adjustment strip 14, the axial position of the end of wear plate 2' which is adjacent to the chip opening following the segment, can be affected. Thus, the chip length can also be set to its desired value.

A disc chipper according to the above described embodiment can further be provided with spacers to be inserted between knife disc 1 and adjustment strip 14, to increase the contact area between adjustment strip 14 and wear plate 2' and thus improve the support of wear plate 2'.

According to a further embodiment of the invention, each segment comprises a knife compression element 19 located in the vicinity of the chip opening preceding the segment in the rotational direction. Additionally, each segment comprises a knife base, also located in the vicinity of the chip opening preceding the segment in the rotational direction, and in addition between the knife compression element 19 and the knife disc 1. The knife compression element is adapted to be pressed against the knife 18, as knife 18 is trapped between knife compression element 19 and knife base 20. The knife compression element and knife base 20 thus represent the mentioned two opposing surfaces for supporting the knife. In addition, between knife base 20 and knife disc 1 is provided an overlying pair of wedges 22, 23, the wedge shapes having opposite directions. The wedge pair 22, 23 function as the mentioned wedge element, whereby the position of the knife base 20 is axially adjustable relative to the knife disc by shifting at least one of the wedges in the pair 22, 23 in the direction of the wedge shape.

Due to the knife base 20 and the knife compression element, the wear plate can be fixed and separate from the knife 18. In this manner, an even smaller internal variation in the position of knives 18 can be achieved. Also the protrusion of individual knives 18 can be better controlled, in other words the variation in the reach of a specific knife between its outer and inner periphery is reduced.

The wedges of wedge pair 22, 23 can be wedge shaped for example in the radial direction relative to knife disc 1. Alternatively, the wedges 22, 23 can have a wedge shape also in the tangential direction relative to knife disc 1. Knife disc 1' or knife base 20 can be provided with a groove corresponding to wedge pair 22, 23.

The invention claimed is:

1. A disc chipper comprising:

a knife disc comprising a plurality of segments, wherein each segment is separated from an adjacent segment by a chip opening extending approximately in a radial direction of the knife disc between an inner and outer periphery of the knife disc;

at least one knife for each segment, wherein the knife is located in the segment in a vicinity of the chip opening preceding the corresponding segment in a rotational direction, wherein the knife extends a distance axially from the knife disc and is supported between two surfaces that oppose each other; and at least one wedge element for each segment, wherein the at least one wedge element is adapted to adjust the position of at least one of the said opposing surfaces relative to the knife disc, to set an axial reach of the knife to a desired value, wherein the at least one wedge element is situated in the segment essentially at an end adjacent to the preceding chip opening.

2. The disc chipper according to claim 1, in which each segment further comprises:

a wear plate located opposite to the knife disc and extending essentially between leading and trailing openings to the segment in the rotational direction;

a knife base located between the knife disc and the wear plate in the vicinity of the opening preceding said segment in the rotational direction, wherein the knife base is adapted to press against the knife, a hinge strip located in said segment essentially at the end adjacent to the opening preceding the segment, between the knife disc and the wear plate, wherein the hinge strip is wedge shaped in the radial direction of the knife disc; and an adjustment strip, located in said segment essentially at the end adjacent to the following opening, between the knife disc and the wear plate, wherein the wear plate and the knife base form the two opposing surfaces for supporting the knife, and the hinge strip acts as the wedge element, wherein the end of the wear plate adjacent to the chip opening preceding said segment in the rotational direction is axially adjustable relative to the knife disc by shifting said hinge strip in the radial direction of the knife disc.

3. The disc chipper according to claim 2, wherein a spacer has been inserted between the knife disc and the adjustment strip, thereby increasing the contact surface between the adjustment strip and the wear plate.

4. The disc chipper according to claim 1, wherein each segment further comprises:

a knife compression element located in the vicinity of the opening preceding said segment in the rotational direction;

a knife base located between the knife compression element and the knife disc, in the vicinity of the opening preceding said segment in the rotational direction; and a pair of overlying wedges located between the knife base and the knife disc, wherein the wedges of the pair are wedge-shaped in opposite directions, wherein the knife compression element is adapted to press against the knife, the knife being trapped between the knife compression element and the knife base, wherein the knife compression element and the knife base form the two opposing surfaces for supporting the knife, wherein the wedge pair functions as the wedge element, and wherein the knife base is axially adjustable as to its location relative to the knife disc by shifting at least one of the pair of wedges in a direction of the wedge shape.

5. The disc chipper according to claim 4, wherein the wedges in the wedge pair have a wedge shape in the radial direction of the knife disc.

6. The disc chipper according to claim 4, wherein the wedges in the wedge pair have a wedge shape in the tangential direction of the knife disc.

* * * * *